United States Patent [19]

Smith

[11] 4,162,470

[45] Jul. 24, 1979

[54] MAGNETIZING APPARATUS AND METHOD FOR PRODUCING A STATICALLY CONVERGED CATHODE RAY TUBE AND PRODUCT THEREOF

[75] Inventor: Joseph L. Smith, Indianapolis, Ind.

[73] Assignee: RCA Corporation, New York, N.Y.

[21] Appl. No.: 819,093

[22] Filed: Jul. 26, 1977

[51] Int. Cl.[2] ..... H01F 7/00

[52] U.S. Cl. ..... 335/210; 335/284

[58] Field of Search ..... 335/210, 213, 212, 284

[56] References Cited

U.S. PATENT DOCUMENTS

| | | | |
|---|---|---|---|
| 3,098,942 | 7/1963 | Reiches | 335/212 |
| 3,497,745 | 2/1970 | Boeing | 335/210 |
| 4,027,219 | 5/1977 | Van Alphen et al. | 335/213 |
| 4,105,983 | 8/1978 | Barten | 335/212 |

*Primary Examiner*—George Harris

*Attorney, Agent, or Firm*—Eugene M. Whitacre; Paul J. Rasmussen; Joseph Laks

[57] ABSTRACT

A magnetizing apparatus for use in the static convergence of three in-line electron beams within a color television receiver cathode ray tube comprises two pluralities of windings. Each plurality is suitably arranged for positioning about a neck portion of the cathode ray tube in proximity to a magnetic material located adjacent to the neck. The windings are adapted to receive a magnetizing current for creating permanently magnetized regions within the magnetic material for producing a magnetic field within the cathode ray tube. The first plurality provides for like motion of the outer electron beams for which a first multiplicity of windings provides for like motion in a first direction and a second multiplicity provides for like motion in a direction substantially orthogonal to the first direction. The second plurality of windings produces a magnetic field for providing opposite motion of the outer electron beams for which a third multiplicity of the second plurality provides for opposite motion in a second direction and a fourth multiplicity provides for opposite motion in a direction substantially orthogonal to the second direction.

22 Claims, 10 Drawing Figures

MAGNETIZING APPARATUS AND METHOD FOR PRODUCING A STATICALLY CONVERGED CATHODE RAY TUBE AND PRODUCT THEREOF

BACKGROUND OF THE INVENTION

This invention relates to static convergence of cathode ray tubes for color television receivers.

Color display systems such as utilized in color television receivers include a cathode ray tube in which three electron beams are modulated by color-representative video signals. The beams impinge on respective color phosphor areas on the inside of the tube viewing screen. To accurately reproduce a color scene, the three beams must be substantially converged at the screen at all points on the raster. The beams may be converged at points away from the center of the raster by utilizing dynamic convergence methods or self-converging techniques, or a combination of both. Regardless of the methods utilized to achieve convergence while the beams are deflected, some provision must be made to statically converge the undeflected beams at the center of the screen. Static convergence devices are necessary because the effect of tolerances in the manufacture of electron beam guns and their assembly into the cathode ray tube neck frequently results in a misconverged condition.

Many static convergence devices include structure for producing adjustable magnetic fields. The devices are placed over the neck of the cathode ray tube and the magnetic fields are appropriately adjusted to provide for static convergence of the electron beams. Such adjustment is accomplished by moving magnetic field producing elements, by rotating magnetized rings about the cathode ray tube neck, or by rotating cylindrical magnets about an axis.

Other static convergence devices, such as disclosed in German Provisional Patent No. 2,611,633, filed Mar. 19, 1976, published Oct. 21, 1976, by Piet Gerard Joseph Barten et al., produce permanent nonadjustable magnetic fields. An auxiliary device having eight coils circumferentially located is placed around the cathode ray tube neck. Appropriately valued DC currents flowing through the coils establish a magnetic field which statically coverges the electron beams. The values of the DC currents provide data to a magnetizing apparatus which magnetizes regions within a sheath of magnetic material producing the aforementioned permanent nonadjustable magnetic fields. The magnetized sheath when placed over the neck of the cathode ray tube statically converges the electron beams.

It is desirable, when using such a magnetic sheath for static convergence, to eliminate the step of utilizing an auxiliary device for determining the locations within the magnetic sheath where magnetized regions are to be established.

A magnetizing apparatus, not utilizing such an auxiliary device, should have magnetizing areas arranged to facilitate uncomplicated operation when directly performing static convergence operations. Furthermore, to prevent adverse interaction of one magnetized region with another, the arrangement of magnetizing elements of the magnetizing apparatus should produce discrete magnetized regions in the sheath with no overlapping of magnetized areas.

SUMMARY OF THE INVENTION

A magnetizing apparatus for use in the static convergence of three in-line electron beams within a color television receiver cathode ray tube comprises two pluralities of windings. Each plurality is suitably arranged for positioning about a neck portion of the cathode ray tube in proximity to a magnetic material located adjacent to the neck. The windings are adapted to receive a magnetizing current for creating permanently magnetized regions within the magnetic material for producing a magnetic field within the cathode ray tube. The first plurality provides for like motion of the outer electron beams in which a first multiplicity of windings provides for like motion in a first direction and a second multiplicity provides for like motion in a direction substantially orthogonal to the first direction. The second plurality of windings produces a magnetic field for providing opposite motion of the outer electron beams in which a third multiplicity of the second plurality provides for opposite motion in a second direction and a fourth multiplicity provides for opposite motion in a direction substantially orthogonal to the second direction.

DESCRIPTION OF THE INVENTION

Figure 1:
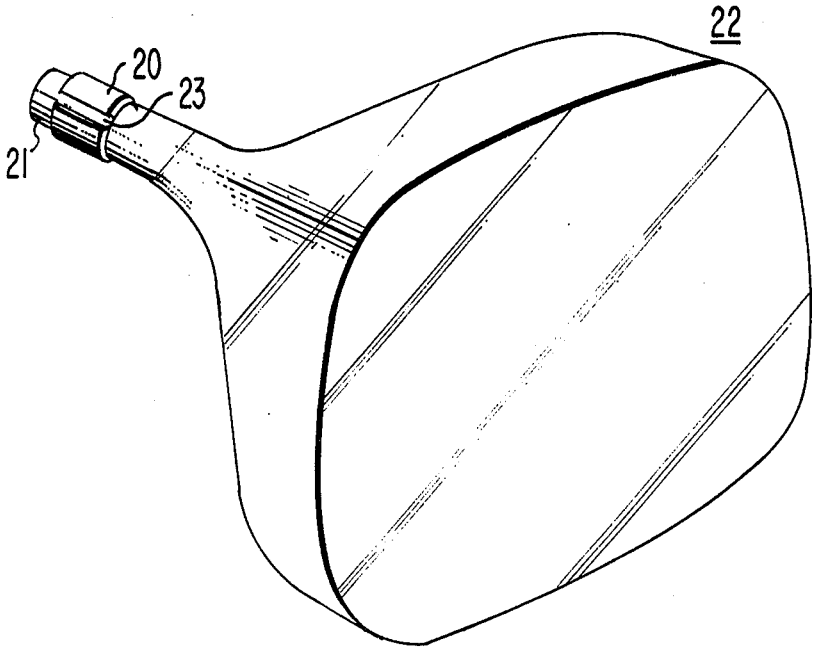
FIG. 1 illustrates a cathode ray tube with a magnetic material in which magnetized regions are created according to the invention.

In FIG. 1, a magnetic material comprising a magnetizable strip or sheath 20 is placed adjacent a neck portion 21 of a cathode ray tube 22. Strip 20 is long enough to be wrapped around neck 21 providing only a small gap 23 to avoid overlying of material. The composition of the magnetic material for strip 20 may be conventional barium ferrite mixed in a rubber or plastic binder material. Strip 20 may be held in a fixed relation to neck 21 by gluing or by wrapping around the strip a thin nonmagnetic tape.

Figure 2:
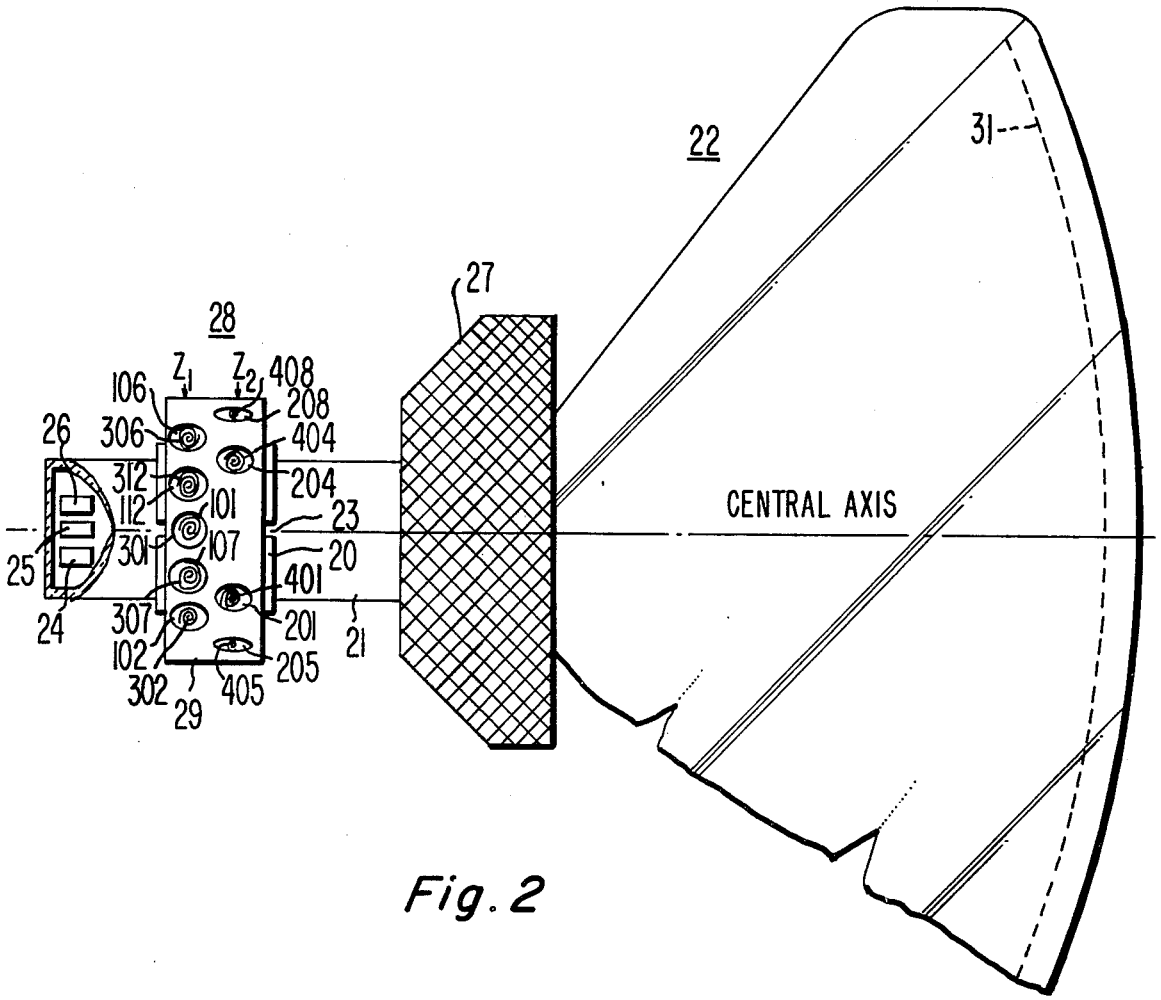
FIG. 2 illustrates a cathode ray tube over which neck is placed a magnetizing apparatus embodying the invention.

As illustrated in FIG. 2, cathode ray tube 22 includes three in-line guns 24, 25, and 26 for producing blue, green, and red electron beams, respectively. The green gun is illustratively along the central axis of the tube. To obtain a raster, a deflection apparatus 27, which may comprise conventional horizontal and vertical windings, is placed around neck 21.

To obtain static convergence of all three beams, permanently magnetized regions of appropriate polarity and pole strength are created in magnetic strip 20. To create these regions, a magnetizing apparatus 28 is placed around magnetic strip 20. Magnetizing apparatus 28 comprises an annular housing 29 of nonmagnetic material within which is formed a first plurality of cavities 101–112, positioned in a first axial plane $Z_1$ along the central axis, and a second plurality of cavities 201–208 positioned in a second adjacent axial plane $Z_2$ along the central axis. In each cavity is located a solenoidal winding for forming first and second pluralities of windings 301–312 and 401–408, respectively.

Figure 3:
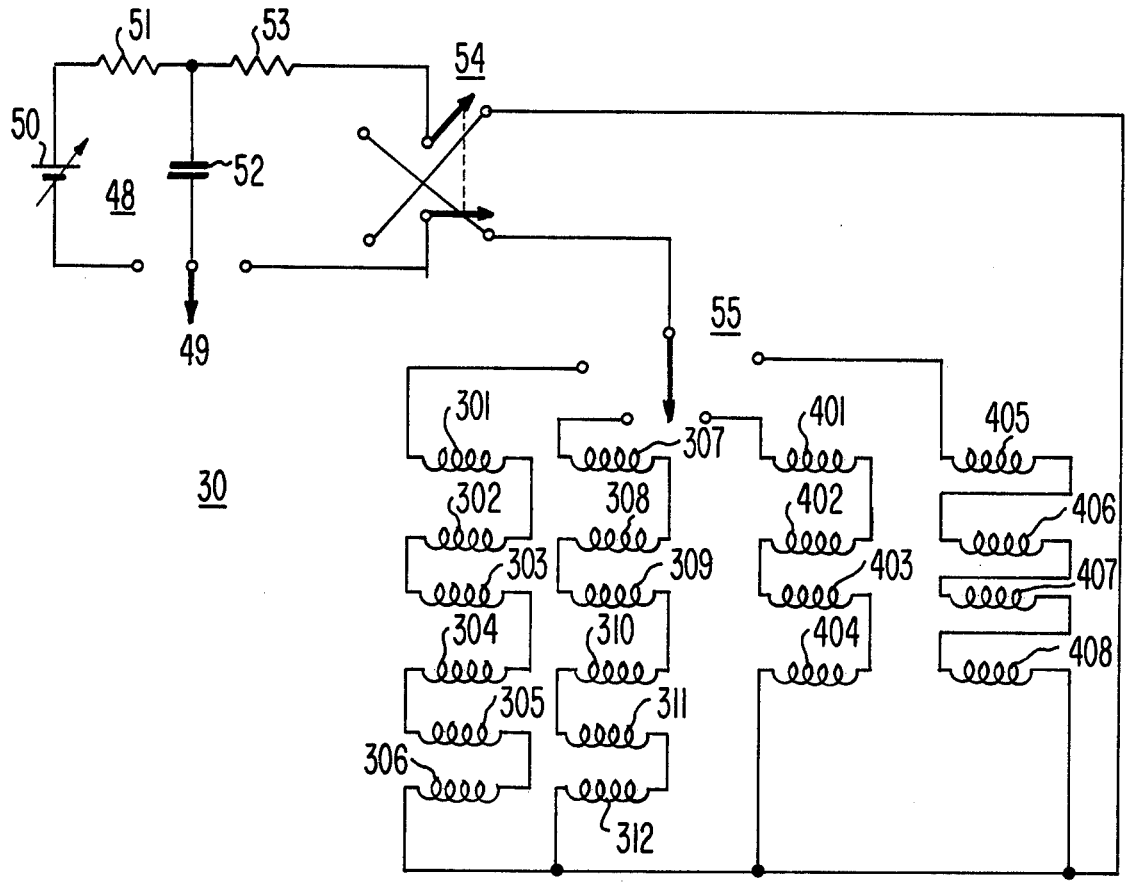
FIG. 3 schematically illustrates a pulsed current driver used in conjunction with a magnetizing apparatus of FIG. 2.

Each of the windings include terminals, not shown, adapted to receive a pulse of magnetizing current from a pulsed current driver unit 30 of FIG. 3 for creating adjacent permanently magnetized regions within the magnetic strip 20. Pulsed current driver 30 comprises a charging circuit 48, a ganged double pole, double throw switch 54 and a selector switch 55, appropriate terminals of which are coupled to appropriate windings of magnetizing apparatus 28. Charging circuit 48 comprises a voltage adjustable battery 50, current limiting resistors 51 and 53, a capacitor 52, and a charge-discharge switch 49 for alternately charging capacitor 52 and then discharging current from capacitor 52 to the appropriate multiplicity of windings selected by switch 55. Switch 54 provides the capability of changing the current direction through the windings.

Figure 4:
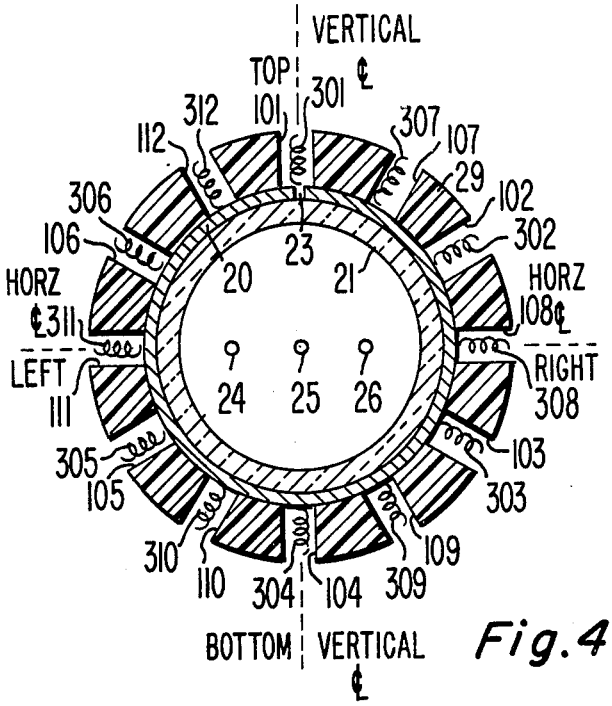
FIGS. 4 and 5 illustrate cross-sectional views of a magnetizing apparatus in two different axial planes about the central axis of the cathode ray tube.

As illustrated in the cross-sectional view of FIG. 4, in the $Z_1$ plane, the first plurality of windings comprises first and second multiplicities of windings. The first multiplicity comprises six windings 301–306, each equiangularly positioned at 60° intervals about the periphery of neck 21, with winding 301 located on the top vertical center line of neck 21. The second multiplicity comprises another six windings 307–312, each equiangularly positioned at 60° intervals about neck 21, each winding of the second multiplicity alternating in angular positioning with a winding of the first multiplicity, with winding 307 located at 30° to the right of the top vertical center line.

Figure 5:
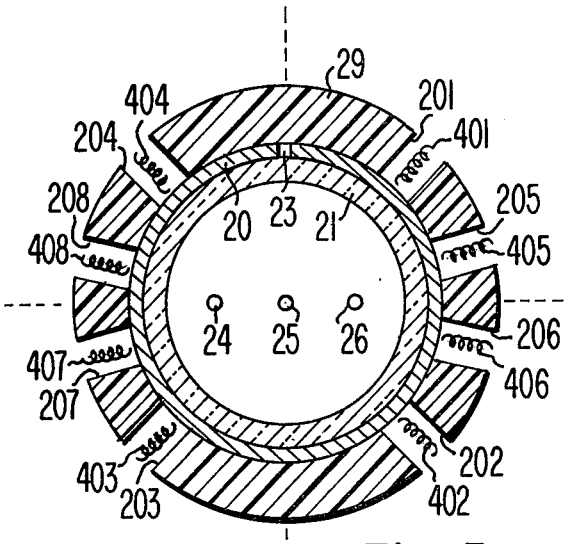

As illustrated in the cross-sectional view of FIG. 5, in the $Z_2$ plane, the second plurality of windings is comprised of third and fourth multiplicities of windings. The third multiplicity comprises four windings 401–404, each equiangularly positioned at 90° intervals about neck 21, with winding 401 located at 45° to the right of the top vertical center line. The fourth multiplicity comprises another four windings 405–408, with a winding angularly located at +15° and at −15° from both the left and right horizontal center lines.

Figure 6:
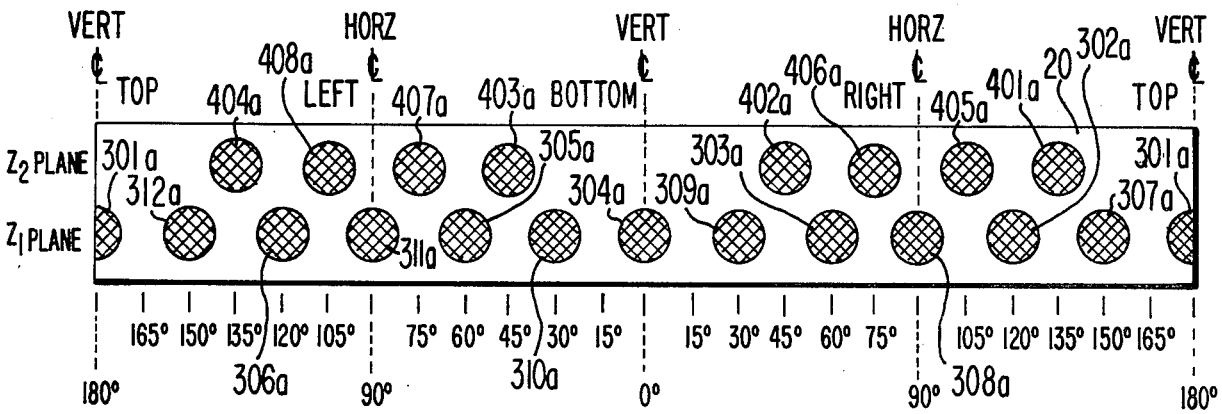
FIG. 6 schematically illustrates permanently magnetized regions along the length of a magnetic material, the regions being created by a magnetizing apparatus embodying the invention.

To permanently magnetize regions within magnetic strip 20, current pulses of appropriate magnitude and direction are coupled to solenoidal windings 301–312 and 401–408 by the operator of driver unit 30. The current in each of the windings produces a magnetizing magnetomotive force equal to $N \times I_p$, where N is the number of turns in a winding, and $I_p$ is the peak current flowing through the winding. In strip 20, under each of the windings, are created well-defined adjacent permanently magnetized regions **301*a*–312*a* and 401*a*–408*a* of appropriate pole strength and polarity, as illustrated in FIG. 6 which schematically represents the magnetized regions lengthwise within strip 20**.

With the arrangement of the solenoidal windings in magnetizing unit 28 as described, well-defined permanently magnetized regions in strip 20 are formed in two compact planes $Z_1$ and $Z_2$ about the central axis of cathode ray tube 22, requiring a minimum of material for forming the strip. As shown in FIG. 6, the central points of magnetized regions of one multiplicity of windings alternate in angular positioning with those of windings of the other three multiplicities. No overlapping of permanently magnetized regions are created in strip 20, that is, the permanently magnetized regions associated with one multiplicity do not have common areas with those of the other multiplicities.

As illustrated in FIG. 3, the windings of the first, second, and third multiplicities are coupled to pulsed current driver unit 30 and to other windings within each multiplicity such that the current alternates in direction in adjacent windings creating alternating polarity magnetized regions for each of the first three multiplicities. The current flows in the same direction in the windings of the fourth multiplicity creating magnetized regions of the same polarity for that multiplicity.

Figure 7:
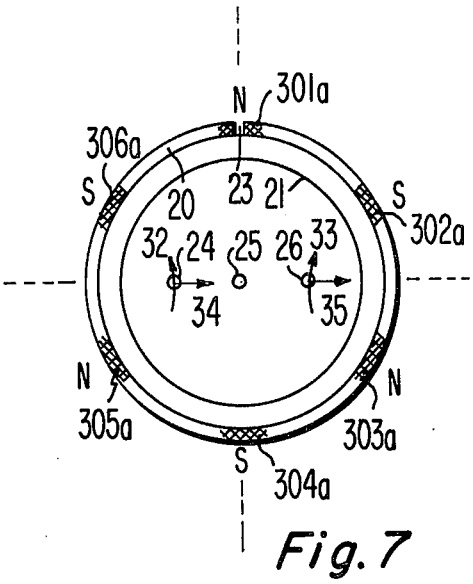
FIGS. 7–10 illustrate magnetic field lines and forces acting on electron beams, the lines and forces being produced by magnetized regions within a magnetic material.
Figure 8:
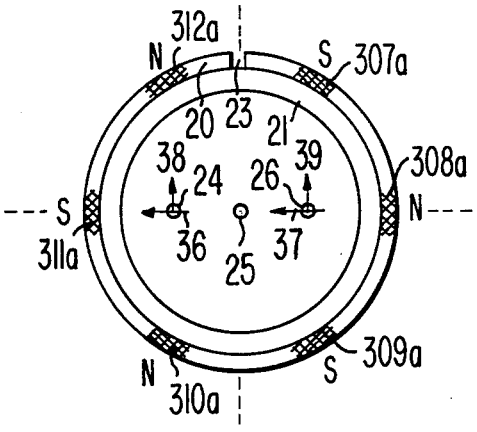

When pulsed with current from driver 30, the first multiplicity creates the permanently magnetized regions **301*a*–306*a* in strip 20 in the $Z_1$ plane, as illustrated in FIG. 7, with region 301*a* illustratively a North polar region. The interior magnetic field acting on the electron beams is substantially a hexapolar or third harmonic field, with the field lines 32 and 33 intersecting the blue and red beams 24 and 26, respectively. The horizontal forces 34 and 35 produced by the field provide like direction horizontal motion on the blue and red beams. When pulsed with current, the second multiplicity creates the permanently magnetized regions 307*a*–312*a* in the $Z_1$ plane, as illustrated in FIG. 8, with region 307*a* illustratively a South polar region. The third harmonic field produced includes field lines 36 and 37 intersecting the blue and red beams 24 and 26, respectively. The horizontal forces 38 and 39** produced by the field provide like direction motion in a substantially orthogonal; i.e., vertical direction on the blue and red beams.

Figure 10:
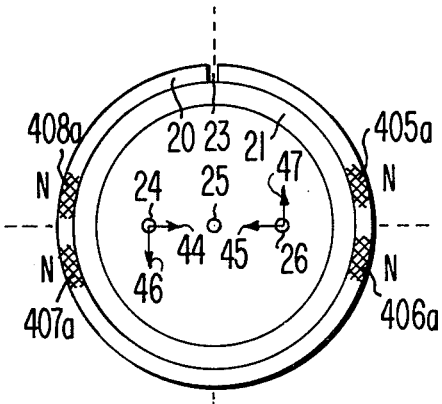
Figure 9:
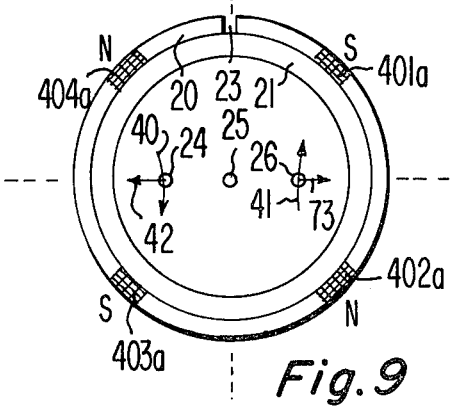

When pulsed with current from driver 30, the third multiplicity creates the permanently magnetized regions **401*a*–404*a* in strip 20 in the $Z_2$ plane, as illustrated in FIG. 9, with region 401*a* illustratively a South polar region. The interior magnetic field is substantially a quadripolar or second harmonic field, with the field lines 40 and 41 intersecting the blue and red beams 24 and 26, respectively. The horizontal forces 42 and 43 produced by the field provide opposite direction horizontal motion on the blue and red beams. When pulsed with current, the fourth multiplicity creates regions 405*a*–408*a* in the $Z_2$ plane, as illustrated in FIG. 10. Because of the winding coupling arrangement, all of the magnetized regions 405*a*–408*a* are of the same polarity, illustratively North polar regions. The interior magnetic field developed is basically an even harmonic field with oppositely directed field lines 44 and 45 producing oppositely directed vertical forces 46 and 47** on the blue and red beams, respectively.

With magnetizing unit 28 capable of creating magnetized regions which produce like and opposite horizontal and vertical motion, the capability of statically converging of the outer two beams onto the central beam is provided. Cathode ray tube 22 is energized, and the undeflected beam landing positions on a screen 31 of the cathode ray tube 22 are observed. The misconvergence errors of each of the beams are noted. Instead of observing undeflected beam landing positions, a conventional cross-hatched raster pattern may be displayed, with the central portion of the pattern displaying the errors.

Once the misconvergence errors are determined, the operator selects an appropriate magnitude and direction for the current pulses that are to be provided by driver unit 30 to each of the four multiplicities. The current pulses may be provided to each of the multiplicities in any order convenient to the operator. After the current pulses are coupled to their respective solenoidal windings creating appropriately magnetized regions, the beam landings or raster lines are again observed, and any remaining errors are noted. New values for the magnitude and direction of the current pulses are selected. New current pulses are coupled to the solenoidal windings, adjusting the strength and possibly also the polarity of the magnetized regions. Such steps are repeated until proper convergence is achieved. A method of coupling magnetizing current pulses to magnetizing apparatus 28 that will stabilize the magnetic material within strip 20 and prevent demagnetization of the magnetized mass with the magnetized regions is disclosed in copending U.S. patent application entitled, MAGNETIZING METHOD FOR USE WITH A CATHODE RAY TUBE, Ser. No. 819,095 filed concurrently herewith, by Joseph Leland Smith.

Since the arrangement of windings in the magnetizing apparatus 28 provides orthogonal, that is, vertical and horizontal components of motion, the motions are easy to visualize by an operator observing the cathode ray tube screen. Static convergence operation is greatly facilitated, and the number of iterations involved may be kept to a minimum, reducing operator setup and adjustment time.

The arrangement of windings for magnetizing apparatus 28 produces a magnetized strip 20 of relatively narrow width with compact permanently magnetized regions in only two closely adjacent axial planes about the central axis. Such narrow width provides added flexability in selecting various combinations of cathode ray tubes 22 and deflection apparatus 27 that have relatively little neck length remaining in which to locate a static convergence device.

The windings are angularly positioned about the neck in a manner providing for nonoverlapping discrete permanently magnetized regions within strip 20, as illustrated in FIG. 6. Because of the nonlinearity of the magnetization curves of the magnetic material of strip 20, if overlap or common areas of magnetized regions of different winding multiplicities existed, establishment of the correct pole strength and polarity for the overlapping regions would become difficult and time consuming. Consider, for example, a situation where windings of the first and fourth multiplicities do overlap. After observing the misconverged condition, the first multiplicity is pulsed with appropriate current for creating magnetized regions for providing like direction horizontal motion to the outer beams. It is then determined, for example, that a further correction of an opposite direction vertical motion is also required. Appropriate current pulses are coupled to the fourth multiplicity. However, because of the nonlinear material characteristics, the magnetized region common to both multiplicities changes nonlinearly in value, upsetting the correction for like direction horizontal motion. The first multiplicity must now be repulsed, which may, in turn, upset the correction for the fourth multiplicity. Thus, by providing an arrangement which creates non-overlapping permanently magnetized regions, undue iteration may be avoided.

Typical characteristics for a magnetic strip 20, cathode ray tube 22, and magnetizing apparatus 28 are as follows:

Magnetic Strip: length 3.8", width 0.675", thickness 0.060", gap width 0.100" maximum, material-barium ferrite mixed in a rubber binder with a B-H of $1.1\times10^6$ gauss-oersteads minimum, such as General Tire Compound 39900 obtained from The General Tire & Rubber Company, Evansville, Ind.

Cathode Ray Tube: 13V in-line, 90° deflection, slot mask, 25KV ultor, gun separation of 0.26 inch, neck diameter 1.146".

Magnetizing Apparatus: solenoidal windings—number of turns 7, diameter 0.2", length 0.25", 20 gauge copper wire, length of each solenoid 0.3", magnetizing current pulse duration 15μsec; maximum outer beam motions required to be provided and corresponding peak currents required to be coupled to the windings—first multiplicity ±75 mils and 1700 amps; second multiplicity ±75 mils and 1700 amps; third multiplicity ±105 mils and 2000 amps; fourth multiplicity ±105 mils and 1600 amps.

Color purity correction for gun misregistrations may be performed by using conventional adjustable two-pole purity ring magnetics. It may alternatively be performed by further creating appropriately magnetized regions in magnetic strip 20. A magnetizing unit capable of creating such regions is disclosed in copending U.S. patent application entitled, MAGNETIZING APPARATUS & METHOD FOR USE IN CORRECTING COLOR PURITY IN A CATHODE RAY TUBE & PRODUCT THEREOF, Ser. No. 819,094, filed concurrently herewith, by Joseph Leland Smith.

What is claimed is:

1. A magnetizing apparatus for use in the static convergence of three in-line electron beams within a cathode ray tube including a magnetic material located adjacent to a neck portion of said cathode ray tube, comprising:

a first plurality of windings suitably arranged for positioning about said neck portion in proximity to said magnetic material and adapted to receive a magnetizing current of sufficient magnitude that will create permanently magnetized regions within said magnetic material that produce a magnetic field within said cathode ray tube for like motion of the outer electron beams, a first multiplicity of windings of said first plurality providing for like motion in a predetermined direction and a second multiplicity providing for like motion in a direction substantially orthogonal to the direction provided by said first multiplicity; and a second plurality of windings suitably arranged for positioning about said neck portion in proximity to said magnetic material and adapted to receive a magnetizing current of sufficient magnitude that will create permanently magnetized regions within said magnetic material that produce a magnetic field within said cathode ray tube for opposite motion of said outer electron beams, a third multiplicity of windings of said second plurality providing for opposite motion in a predetermined direction and a fourth multiplicity providing for opposite motion in a direction substantially orthogonal to the direction provided by said third multiplicity, said first and second pluralities located in two planes generally perpendicular to the central axis of said cathode ray tube, the windings of said first and second pluralities so angularly oriented about said neck portion as to create compact nonoverlapping permanently magnetized regions.

2. Apparatus according to claim 1 wherein the windings of said first and second plurality of windings comprise solenoidal coils.

3. Apparatus according to claim 1 wherein said first multiplicity comprises six windings suitably arranged for equiangular positioning about said neck portion, one of said six windings located on a vertical center line of said cathode ray tube for providing like motion in a horizontal direction.

4. Apparatus according to claim 3 wherein said second multiplicity comprises six windings suitably arranged for equiangular positioning about said neck portion, one of said six windings angularly located 30° from a vertical center line for providing like motion in a vertical direction.

5. Apparatus according to claim 4 wherein said third multiplicity comprises four windings suitably arranged for equiangular positioning about said neck portion, one of said four windings angularly located 45° from a vertical center line for providing opposite motion in a horizontal direction.

6. Apparatus according to claim 5 wherein said fourth multiplicity comprises four windings adapted to receive magnetizing current of the same direction, a winding of said four windings of said fourth multiplicity angularly located at approximately 15° from a horizontal center line for providing opposite motion in a vertical direction.

7. Apparatus according to claim 1 wherein said first multiplicity of windings creates permanently magnetized regions for producing a six-pole magnetic field so oriented within said cathode ray tube as to provide for like motion in a horizontal direction.

8. Apparatus according to claim 7 wherein said second multiplicity creates permanently magnetized regions for producing a six-pole magnetic field so oriented within said cathode ray tube as to provide for like motion in a vertical direction.

9. Apparatus according to claim 8 wherein said third multiplicity creates permanently magnetized regions for producing a four-pole magnetic field so oriented within said cathode ray tube as to provide for opposite motion in a horizontal direction.

10. Apparatus according to claim 9 wherein said fourth multiplicity creates permanently magnetized regions of the same polarity, a magnetized region angularly located adjacent to a horizontal center line for providing opposite motion in a vertical direction.

11. Apparatus according to claim 1 wherein said first multiplicity comprises six windings spaced about a periphery for providing said like motion in a predetermined direction and wherein said second multiplicity comprises six windings spaced about said periphery, a winding of said second multiplicity alternating in angular position with a winding of said first multiplicity for providing said like motion in a direction substantially orthogonal to the direction provided by said first multiplicity.

12. Apparatus according to claim 11 wherein said third multiplicity comprises four windings equiangularly spaced about said periphery for providing said opposite motion in a predetermined direction.

13. Apparatus according to claim 12 wherein a winding of said third multiplicity is angularly positioned between adjacent windings of said first and second multiplicities.

14. Apparatus according to claim 13 wherein said fourth multiplicity comprises four windings, each winding adapted to receive magnetizing current of the same direction for providing said opposite motion in said direction orthogonal to the direction provided by said third multiplicity.

15. In a color television receiver including a cathode ray tube with three in-line electron beams, a magnetic material located adjacent to a neck portion of said cathode ray tube including permanently magnetized regions for statically converging said electron beams, said permanently magnetized regions created by the magnetizing apparatus of claim 1.

16. A static convergence magnetizing apparatus for creating permanently magnetized regions within a magnetic material located adjacent to a neck portion of a cathode ray tube, said cathode ray tube including three in-line electron beams, comprising:

first and second pluralities of windings suitably arranged for positioning in first and second axial planes respectively about the periphery of said neck portion in proximity to said magnetic material, each winding capable of receiving a magnetizing current the direction and magnitude of which is selected for creating said permanently magnetized regions to converge the outer of said three in-line electron beams onto the central beam, the angular positioning of a winding about said periphery such as to create a permanently magnetized region having no common area with that of a permanently magnetized region created by another of said windings.

17. Apparatus according to claim 16 wherein each of said pluralities comprises at least two multiplicities, a first multiplicity for providing to said outer electron beams like motion in a predetermined direction, a second multiplicity for providing like motion in a direction substantially orthogonal to the direction provided by said first multiplicity, a third multiplicity for providing opposite motion in a predetermined direction, and a fourth multiplicity for providing opposite motion in a direction substantially orthogonal to the direction provided by said third multiplicity.

18. Apparatus according to claim 17 wherein the current in each winding of one of said multiplicities flows in a direction for creating magnetized regions of the same polarity.

19. In a color television receiver including a cathode ray tube with three in-line electron beams, a magnetic material located adjacent to a neck portion of said cathode ray tube including permanently magnetized regions for statically converging said electron beams, said permanently magnetized regions created by the magnetizing apparatus of claim 16.

20. A method of statically converging three in-line electron beams of a cathode ray tube comprising the steps of:

locating a magnetic material adjacent a neck portion of said cathode ray tube;

determining the misconvergence of said three in-line electron beams;

positioning about said neck portion in substantially two planes generally perpendicular to the central axis of said cathode ray tube four multiplicities of windings, each winding adapted to receive a magnetizing current for creating permanently magnetized regions within said magnetic material capable of statically converging said three in-line electron beams;

coupling to said first multiplicity current of appropriate magnitude and direction for providing like directed motion of the outer electron beams in a predetermined direction;

coupling to said second multiplicity current of appropriate magnitude and direction for providing like directed motion in a direction substantially orthogonal to the direction provided by said first multiplicity;

coupling to said third multiplicity current of appropriate magnitude and direction for providing oppositely directed motion of the outer electron beams in a predetermined direction; and coupling to said fourth multiplicity current of appropriate magnitude and direction for providing oppositely directed motion in a direction substantially orthogonal to the direction provided by said third multiplicity for statically converging said three in-line electron beams, the angular positioning of the windings of said four multiplicities creating compact nonoverlapping permanently magnetized regions.

21. Apparatus according to claim 1 wherein the current in each winding of said fourth multiplicity flows in a direction that creates magnetized regions of the same polarity.

22. An in-line cathode ray tube with at least one strip of magnetic material located adjacent said neck portion, said strip comprising first and second pluralities of permanently magnetized regions located respectively in first and second planes generally perpendicular to the central axis of said cathode ray tube, each of said permanently magnetized regions angularly oriented about said cathode ray tube in a nonoverlapping manner such that no two of said permanently magnetized regions have a common area, said permanently magnetized regions fixedly located with polarities and pole strengths selected to statically converge the electron beams of said in-line cathode ray tube.

* * * * *